United States Patent [19]

Ohmukai et al.

[11] 4,279,589

[45] Jul. 21, 1981

[54] COMBUSTION DEVICE FOR LIQUID FUELS

[75] Inventors: Yoshimi Ohmukai, Hirakata; Takeshi Tomisawa, Katano; Yoshitaka Kawasaki, Nara, all of Japan

[73] Assignee: Matsushita Electric Industrial Co., Ltd., Osaka, Japan

[21] Appl. No.: 914,856

[22] Filed: Jun. 12, 1978

[30] Foreign Application Priority Data

Jun. 15, 1977 [JP] Japan ..... 52-071301
Oct. 11, 1977 [JP] Japan ..... 52-122188

[51] Int. Cl.[3] ..... F23D 13/12
[52] U.S. Cl. ..... 431/328
[58] Field of Search ..... 431/300, 313, 314, 328, 431/326, 201, 195, 220

[56] References Cited

U.S. PATENT DOCUMENTS

| | | | |
|---|---|---|---|
| 614,417 | 11/1898 | Blount | 431/195 |
| 2,254,248 | 9/1941 | Stirlen | 431/195 |
| 2,286,446 | 6/1942 | Tessmer | 431/300 |
| 2,482,797 | 9/1949 | Quinnell et al. | 431/195 |
| 3,531,229 | 9/1970 | Bergluhd | 431/328 |
| 3,650,661 | 3/1972 | Laguinia | 431/328 |

FOREIGN PATENT DOCUMENTS

| | | |
|---|---|---|
| 45-9709 | of 1970 | Japan . |
| 47-26632 | of 1972 | Japan . |
| 48-27651 | of 1973 | Japan . |
| 51-15136 | of 1976 | Japan . |

*Primary Examiner*—Carroll B. Dority, Jr.
*Attorney, Agent, or Firm*—Joseph W. Farley

[57] ABSTRACT

A device comprises a primary combustion space adjacent the fuel vaporizing portion of a porous body exposed thereto, and a secondary combustion space provided downstream from the primary combustion space. Of the primary air supply to the primary combustion space and the secondary air supply to the secondary combustion space, at least the flow of the primary air is regulated by an air regulator to steplessly vary the calorific value while maintaining satisfactory combustion.

11 Claims, 4 Drawing Figures

COMBUSTION DEVICE FOR LIQUID FUELS

The present invention relates to a combustion device for liquid fuels.

With devices for burning a liquid fuel such as kerosene, the calorific value is usually adjusted by regulating the fuel supply to the device. Fuel supply regulators heretofore used or proposed include, for example, those consisting essentially of valve means, or a pump which is operable at a variable speed, or a centrifugal atomizer which is rotatable at a variable speed. These regulators have the drawback that the main operative portion, which is inevitably exposed to the fuel, is prone to corrosion due to the presence of water in the fuel or of organic acids resulting from partial degradation of the fuel, or is subject to malfunction due to the deposition of some separated components of the fuel. Such regulators have another drawback that the fuel is likely to leak from the portion of the device to which the regulator is attached. Moreover, the conventional regulators involve difficulties in maintenance.

To achieve an ideal combustion efficiency with a clean exhaust gas containing a reduced amount of carbon monoxide or soot and to thereby assure a high heat exchange efficiency, it is desirable to maintain a constant excess air factor as is widely known. However, it has been extremely difficult, and in fact economically infeasible, to maintain a substantially constant excess air factor independently of the calorific value which is actually variable steplessly.

Even with a liquid fuel burning device which is adapted for satisfactory combustion under ideal conditions, the air supply, if set to an optimum value, will vary when the device is affected by the external air pressure through the air intake or exhaust gas outlet or when the air or exhaust gas channel involves varying resistances for one cause or another. Thus degradation tends to result in the quality of combustion. The term "degradation in the quality of combustion" refers, for example, to emission of a gas containing large amounts of carbon monoxide and like poisonous components; deposition of the resulting soot in the heat exchanger, leading to a reduced heat exchange efficiency; and deposition of the resulting soot in the exhaust gas channel, giving increased resistance to the flow of the gas and consequently entailing a reduced air supply to promote impaired combustion.

A first object of this invention is to provide a combustion device for liquid fuels in which the calorific value is easily adjustable and which is free of the drawbacks of conventional devices.

A second object of this invention is to provide a combustion device for liquid fuels in which a substantially constant excess air factor can be automatically maintained even when the calorific value is altered over a wide range.

A third object of this invention is to provide a combustion device for liquid fuels which automatically maintains satisfactory combustion when used under ambient conditions that would involve an external influence as of wind.

To fulfil the first object of this invention, this invention provides a combustion device for a liquid fuel comprising a porous body having a fuel receiving portion for containing the fuel in the form of a liquid phase and a fuel vaporizing portion continuous with the fuel receiving portion, means for supplying the fuel to the porous body, a primary combustion space adjacent the fuel vaporizing portion of the porous body exposed thereto, a secondary combustion space provided downstream from the primary combustion space, air supplying means for supplying primary air to the primary combustion space and secondary air to the secondary combustion space, and an air flow regulator for regulating at least the flow of the primary air of the air supply.

Other features and advantages of this invention will become more apparent from the description of embodiments thereof given below with reference to the accompanying drawings, in which.

Figure 1:
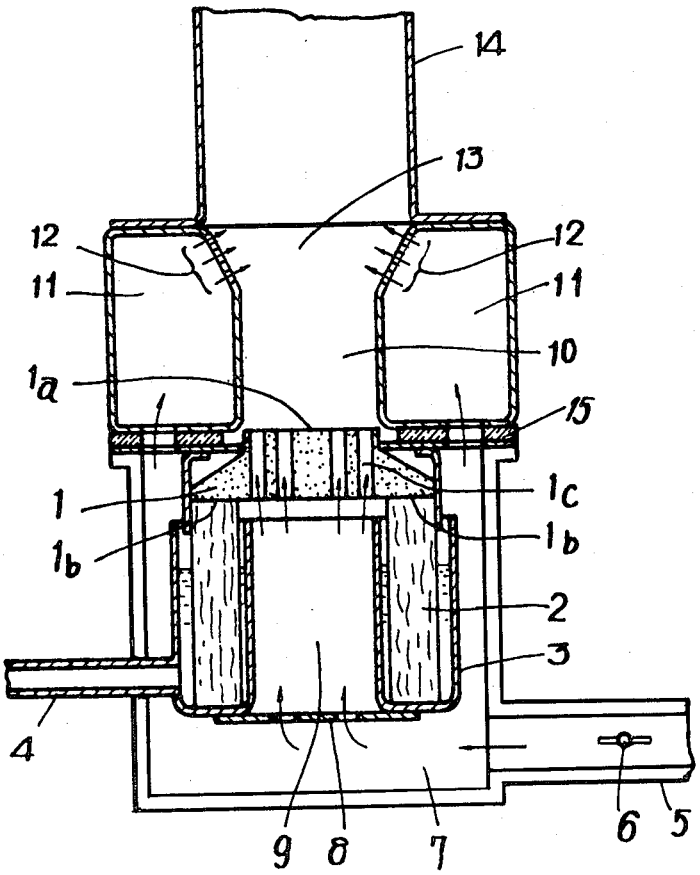
FIG. 1 is a fragmentary view showing a first embodiment of this invention including a horizontally elongated combustion assembly, the view being in vertical section at a longitudinally intermediate portion of the embodiment.

With reference to FIG. 1, a porous body 1 made of suitable heat-resistant material such as silica-alumina refractory has a fuel vaporizing portion 1*a* at its one side and a fuel receiving portion 1*b* at the other side thereof. The porous body 1 is formed with a plurality of bores 1*c* for passing primary air therethrough. A pair of fuel applicators 2 made of material suitable for drawing up fuels has a lower portion immersed in the liquid fuel such as kerosene in a subtank 3 and an upper portion in intimate contact with the fuel receiving portion 1*b* of the porous body 1. A fuel supply conduit 4 provides a channel for supplying the fuel from an unillustrated main tank to the subtank 3. Thus the fuel contained in the unillustrated main tank is passed through the fuel conduit 4 into the subtank 3 first, from which the fuel is drawn up by the applicators 2, passed through the fuel receiving portion 1*b* and thereafter reaches the fuel vaporizing portion 1*a*.

An air supply conduit 5 extends from an unillustrated blower. An air flow regulator 6 such as a damper is manually or automatically operable from outside.

The illustrated device includes wall means providing: a main air chamber 7, a primary air chamber 9, a primary combustion space 10 adjacent the fuel vaporization portion 1*a*, a secondary air chamber 11, and a secondary combustion space 13 arranged downstream and distinctly separate from the primary combustion space. Thus the air supplied by an unillustrated blower enters the main air chamber 7 first by way of the air supply conduit 5 and the air flow regulator 6 and then flows out from the main air chamber 7 through the air ratio adjusting plate 8 into a primary air chamber 9. The air in the chamber 9 is supplied to the primary combustion space 10 through the primary air bores 1*c*. Secondary air flows out from the main air chamber 7 into the secondary air chamber 11, from which the air is supplied to the secondary combustion space 13 through the secondary air ports 12. Indicated at 14 is part of the heat exchanger, by which the high-temperature gas resulting from combustion is subjected to heat exchange. The gas is thereafter run off from the device. The heat energy obtained from the heat exchanger is used for heating air or water. Indicated at 15 is a heat insulator.

Figure 2:
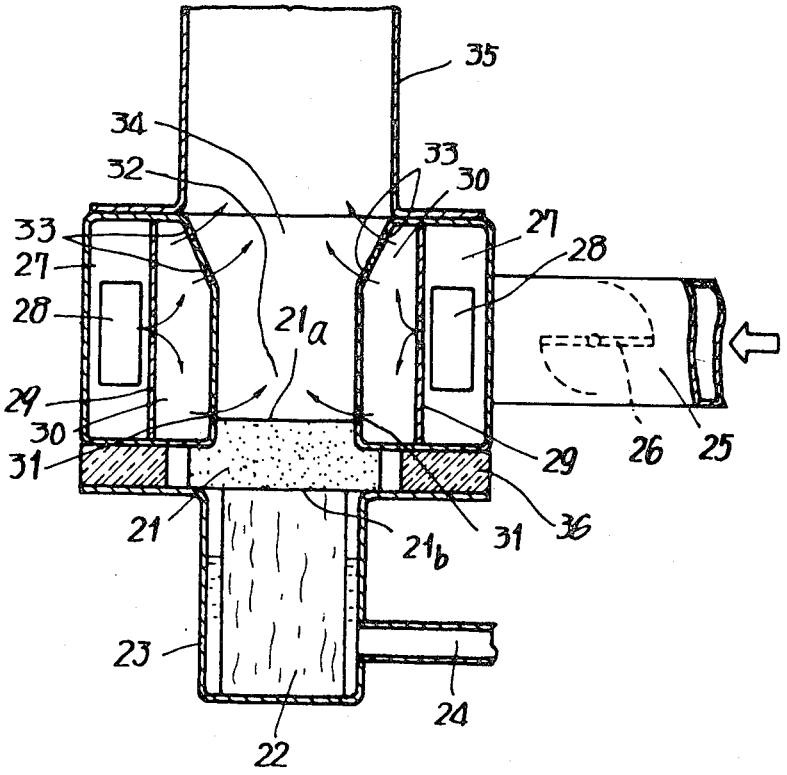
FIG. 2 is a view in vertical section similar to FIG. 1 and showing a second embodiment.

With reference to FIG. 2, a porous body 21, for example, consisting mainly of silica-alumina material has a fuel vaporizing portion 21*a* and a fuel receiving portion 21*b* but is not formed with the primary air bores 1*c* of the embodiment shown in FIG. 1. Indicated at 22 is a fuel applicator, at 23 a subtank and at 24 a fuel supply conduit in communication with an unillustrated main tank which contains a liquid fuel such as kerosene. The fuel is introduced into the subtank 23 through the conduit 24 and then led to the fuel vaporizing portion 21*a* through the applicator 22 and the fuel receiving portion 21*b* of the body 21.

An air supply conduit 25 extends from an unillustrated blower. The embodiment further has an air flow regulator 26 such as a damper, and wall means providing: a main air chamber 27 having inlet apertures 28, a subordinate air chamber 30 separated from the main air chamber 27 by a pressure regulating plate 29, a primary combustion space 32 adjacent the fuel vaporizing portion 21*a*, and a secondary combustion space 34 arranged downstream and distinctly separate from the primary combustion space. Part of a heat exchanger is indicated at 35, and a heat insulator at 36. The air sent forward from the blower is passed through the air conduit 25 and the air regulator 26 first and then led through the air inlet apertures 28 into the main air chamber 27, from which the air is passed through the pressure regulating plate 29 into the subordinate air chamber 30. From the subordinate air chamber 30, primary air flows through the primary air ports 31 into the primary combustion space 32, while secondary air flows through the secondary air ports 33 into the secondary combustion space 34. Indicated by arrows in FIGS. 1 and 2 are directions in which the air flows.

The embodiment of FIG. 2 differs from that of FIG. 1 in that whereas the primary air in FIG. 1 is supplied to the primary combustion space 10 through the primary air bores 1*c* formed in the porous body 1, the primary air in FIG. 2 is supplied to the primary combustion space 32 through the primary air ports 31 formed in the wall defining the primary combustion space 32. Although the two embodiments thus differ from each other in specific construction, they are based on the same concept with respect to the effects achieved as well as to the operation producing the effects.

The operation of the present device will now be described theoretically. With the construction described, the amount of liquid fuel to be vaporized is spontaneously controlled in proportion to the difference between the vapor pressure of the fuel contained in the form of a liquid phase in the fuel vaporizing portion 1*a* or 21*a* of the porous body 1 or 21 and the pressure of the vapor phase in the primary combustion space 10 or 32 to which the fuel vaporizing portion is exposed. Further the sensible heat and latent heat required for the vaporization of the liquid fuel are in proportion to the amount of fuel to be vaporized. When the primary air is introduced into the primary combustion space 10 or 32, primary combustion produces heat at a rate in proportion to the primary air supply. At the same time, the heat raises the vapor pressure of the liquid phase fuel and the primary air forces out the fuel vapor from the zone adjacent the fuel vaporizing portion 1*a* or 21*a*, giving rise to a vapor pressure difference between the vapor and liquid phases in proportion to the primary air supply. Consequently the heat resulting from the primary combustion and the vapor pressure difference coact to vaporize the liquid fuel in proportion to the primary air supply. Thus if the primary air supply is doubled, twice as much primary combustion takes place, producing a twofold amount of heat and a twofold vapor pressure difference between the vapor and liquid phases, so that the rate of vaporization of the liquid fuel automatically increases twofold. A twofold amount of heat will then be required for heating the fresh low-temperature liquid fuel led to the fuel vaporizing portion 1*a* or 21*a* so as to maintain the fuel at the vaporizing portion 1*a* or 21*a* at a steady temperature. The amount of heat needed to compensate for the latent heat attendant on vaporization will be twofold. As a result, the fuel continuously vaporizes at a twofold rate.

When the sum of the primary and secondary air supplies is controlled, the primary air supply and the secondary air supply are automatically determined in accordance with the resistance ratio between the primary air passage and the secondary air passage. Provided that the two passages are under fixed conditions, the ratio between the two air supplies will remain constant even if the sum of the air supplies is controlled. Thus if the sum of the air supplies is doubled, the primary air supply as well as the secondary air supply will be doubled. It therefore follows that the ratio of the doubled fuel vaporization rate resulting from the doubled primary air supply to the combined air supply remains constant despite the altered air supply.

According to the present invention, the capillary attraction afforded by the porous body 1 or 21 is utilized to draw up the fuel to the fuel vaporizing portion 1*a* or 21*a*, because the ability to supply the fuel in this manner is so amenable that the porous body apparently ensures a supply equal to the fuel vaporization rate in spite of variations in the vaporization rate insofar as its inherent capillary ability is taken into consideration when designing the device. A fuel supply system incorporating control means could be ingeniously built to have an equivalent function, but the system would invariably be very expensive and complex in construction. Such a system, although prohibitively costly, would nevertheless be susceptible to malfunction, which would lead to an overflow of the liquid fuel and fire hazards or would alter the proper excess air factor, permitting emission of a large quantity of toxic gas.

The air which is supplied by a blower in the embodiments of FIGS. 1 and 2 may alternatively be supplied by a system utilizing the buoyancy of the combustion gas. With these embodiments, the fuel is lighted by an electric heating element provided close to a desired point of the fuel vaporizing portion 1*a* or 21*a*, but some other suitable ignition means is alternatively usable. Further with the embodiments described, the fire is extinguished by stopping the fuel supply to the subtank 3 or 23, but since it is several minutes after following this procedure that the fire actually goes out according to this method, means for completely stopping the air supply may be used conjointly with this method. The fire will then be extinguishable in 10 seconds. When the blower stops owing to a power failure during combustion, the fire completely goes out in about 2 minutes. After the power failure has been remedied, the device is usable without necessitating any preparative procedure.

Figure 3:
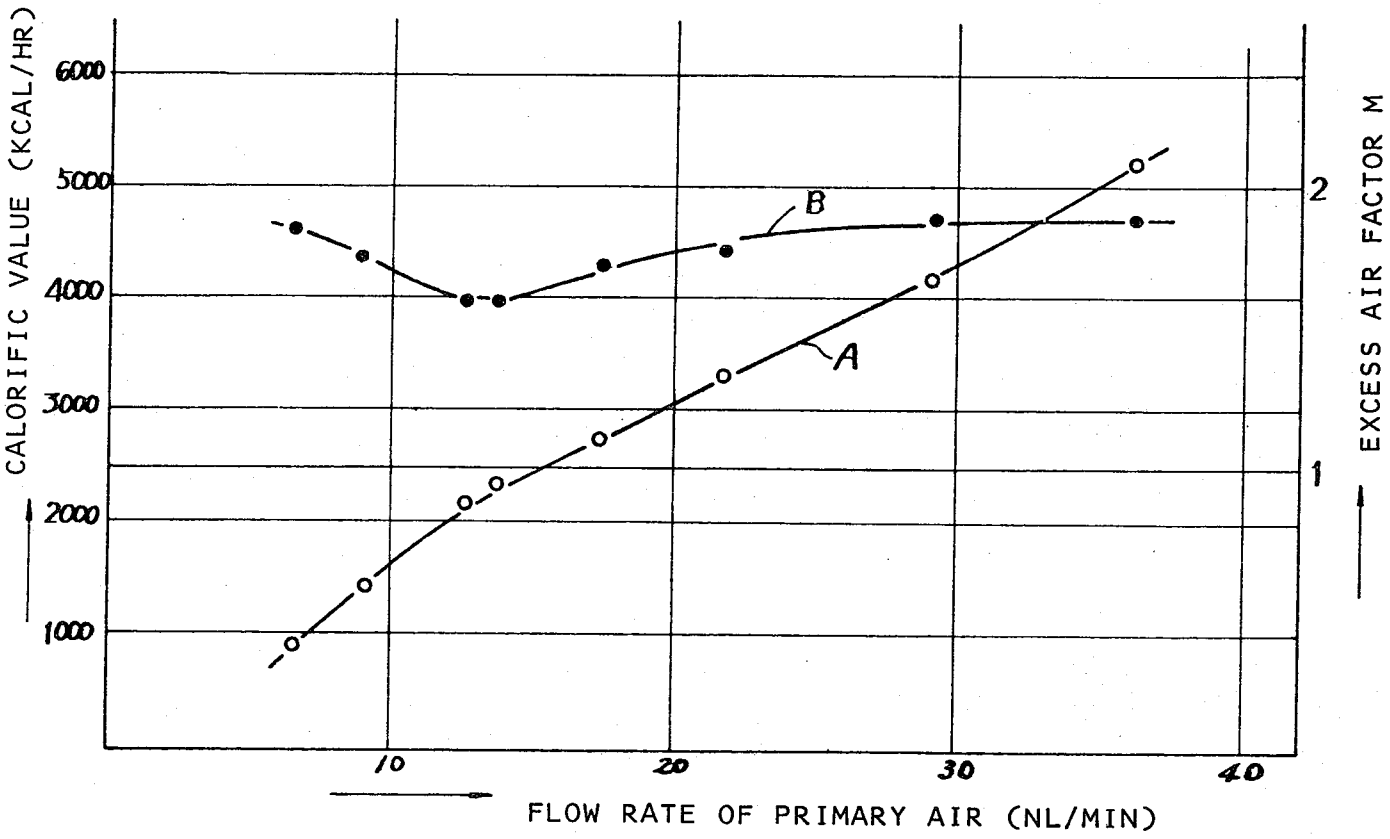
FIG. 3 is a graph showing variations in the calorific value and in the excess air factor relative to variations in the air flow rate.

The advantages of the liquid fuel combustion device of this invention will now be described. The first advantage of the present device is that the rate of vaporization of the fuel is automatically adjustable by regulating the air flow by the air flow regulators 6 and 26 in the embodiments of FIGS. 1 and 2. These embodiments are so adapted that the sum of the primary and secondary air supplies is regulated to fulfil all the objects of this invention at the same time. To fulfil the first object of this invention alone, the flow rate of the primary air only may be regulated. With reference to FIG. 3, Line A represents the rate of vaporization of the fuel (calorific value) which varies with the flow rate of the primary air. It is seen that the calorific value is steplessly adjustable substantially in proportion to the air flow rate as will be described below in greater detail. This completely eliminates the foregoing drawbacks of conventional devices in which the fuel supply is directly regulated.

Another advantage of this invention is that a substantially constant excess air factor, as well as the first advantage, can be automatically obtained independently of variations in the calorific value by regulating the flow of air corresponding to the sum of the primary and secondary air supplies. Accordingly even when the device is operated with varying calorific values, the resulting exhaust gas is extremely clean, containing only a greatly reduced concentration of highly toxic carbon monoxide and substantially free from soot. Thus the heat exchange efficiency can be maintained at a high level. With reference to FIG. 3, Line B represents variations in the excess air factor when the calorific value is altered by regulating the sum of primary and secondary air flows. The excess air factor m is a ratio of the amount of air to the stoichiometric amount of air required for a given amount of fuel. Line B in FIG. 3 indicates that a substantially constant excess air factor is available at varying calorific values in the range of about 1,000 Kcal/hr. to about 5,000 Kcal/hr. In terms of stoichiometric equivalent ratio, the amount of air is in the range of about 1.6 to 1.9 times the fuel amount.

Figure 4:
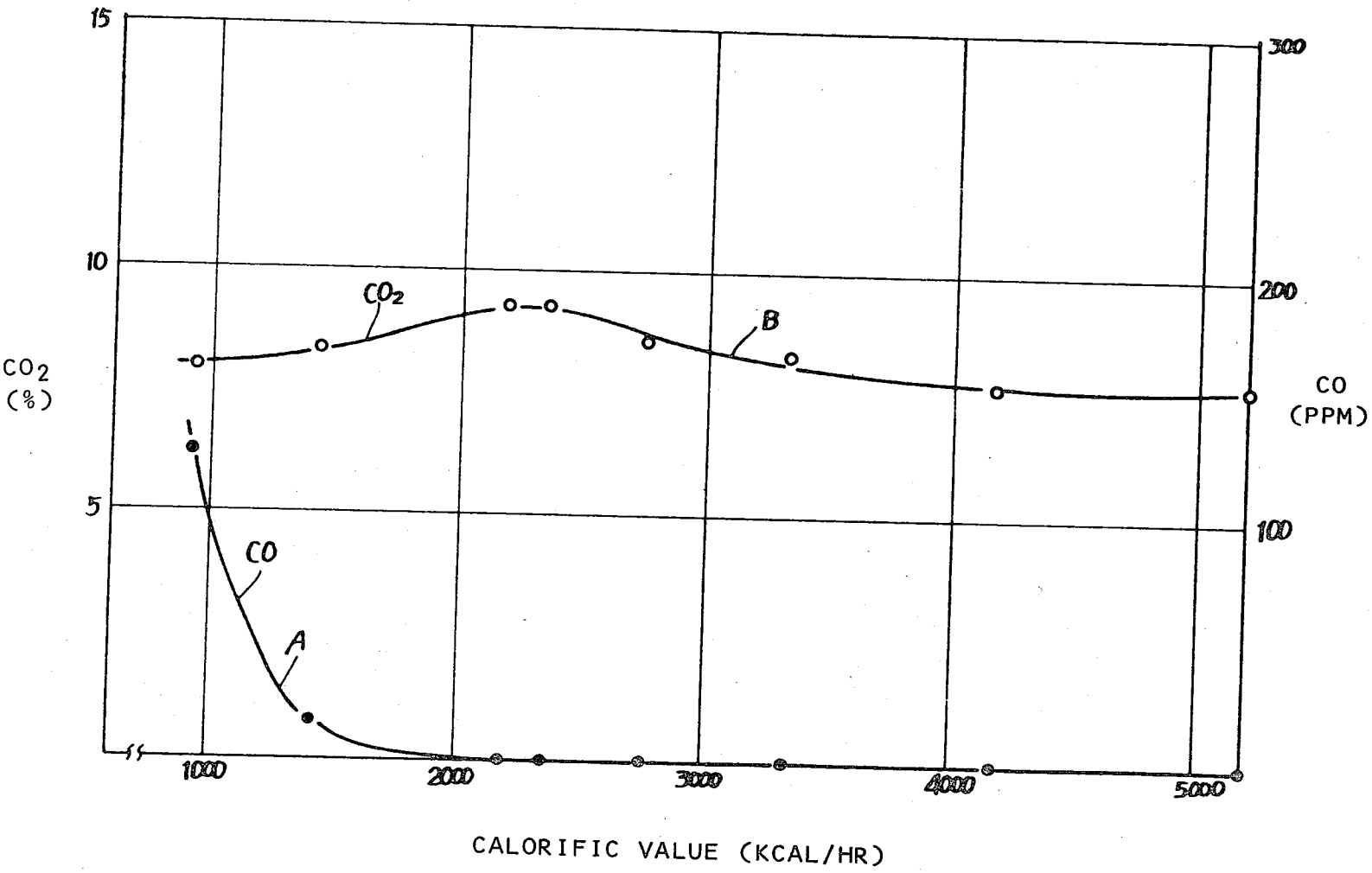
FIG. 4 is a graph showing variations in the $CO_2$ and CO concentrations of the exhaust gas relative to variations in the calorific value.

With reference to FIG. 4, Line A represents the concentration of carbon monoxide in the exhaust gas relative to the calorific value. It is seen that the carbon monoxide concentration is almost zero over the major range of calorific values. In view of the performance of the measuring instrument used, this indicates that the concentration is not higher than 1 ppm. Line B in FIG. 4 represents the concentration of carbon dioxide in the exhaust gas relative to the calorific value. The carbon dioxide concentration is almost constant over the whole range, revealing that the excess air factor is substantially constant.

Another advantage of this invention is that the device operates without entailing degradation in the quality of combustion even under ambient conditions which are not standard and involve, for example, an influence of wind. The results shown in FIGS. 3 and 4 reveal that the device is operable free of any trouble even when the air flow rate varies as affected by the external air pressure through the air intake or exhaust gas outlet.

To sum up, the embodiments shown in FIGS. 1 and 2 have the following advantages. Since the amount of combustion is adjustable by regulating the air flow rate, the calorific value can be adjusted steplessly over a wide range. Because the excess air factor can be automatically maintained at a constant level notwithstanding the adjustment of the calorific value, the exhaust gas released from the device is clean at all times despite the adjustment of combustion. The present device further ensures satisfactory combustion free of any degradation even when subjected to an external influence during use. While the development of liquid fuel combustion devices having such characteristics have long been desired by those skilled in the art as well as users, the present invention thus fulfils all the desirable requirements. Moreover, the device of this invention, which does not require any expensive material or parts, can be manufactured at a very low cost.

What is claimed is:

1. A combustion device for liquid fuel comprising:
   - a porous body having a fuel receiving portion for containing the fuel in the form of a liquid phase and a fuel vaporizing portion continuous with the fuel receiving portion;
   - means for supplying the fuel to the fuel receiving portion of the porous body;
   - wall means for providing a main air chamber, a primary combustion space adjacent the fuel vaporizing portion of the porous body, said vaporizing portion being exposed to said primary combustion space, and for providing a secondary combustion space arranged downstream and distinctly separate from the primary combustion space;
   - air supply means for supplying primary air to the primary combustion space and secondary air to the secondary combustion space, said air supply means and said wall means serving to prevent contact between the secondary air and said porous body, and including separate passage means from said main air chamber to the primary and secondary combustion spaces for determining the ratio of the primary air to the secondary air supplied to said primary and secondary combustion spaces, respectively; and
   - air flow regulating means for adjusting calorific value by regulating at least the primary air of the air supply.

2. A combustion device as defined in claim 1 wherein said passage means includes a plurality of bores formed in the porous body for supplying the primary air to the primary combustion space therethrough.

3. A combustion device as defined in claim 1 wherein said passage means includes a plurality of ports formed in the wall means for supplying the primary air to the primary combustion space therethrough.

4. A combustion device as defined in claim 1 wherein said air supply means includes an air supply channel to the main air chamber and wherein said air flow regulating means comprises a damper in said air supply channel.

5. A combustion device as defined in claim 1 or 2 wherein said main air chamber surrounds both said porous body and said means for supplying the fuel to the fuel receiving portion thereof.

6. A combustion device as defined in claim 5 wherein said air flow regulating means is provided upstream from said main air chamber.

7. A combustion device as defined in claim 6 further comprising a primary air chamber provided between said main air chamber and said porous body, and said passage means includes an air passage between the main air chamber and the primary air chamber.

8. A combustion device as defined in claim 1 or 3 wherein said primary combustion space is surrounded by said main air chamber.

9. A combustion device as defined in claim 8 further comprising a subordinate air chamber provided between said main air chamber and said primary combustion space, and a pressure regulating plate is provided between the main air chamber and the subordinate air chamber.

10. A combustion device as defined in claim 8 wherein said air flow regulating means is provided upstream from said main air chamber.

11. A combustion device as defined in claim 1 wherein said fuel supplying means is arranged below said primary combustion space, and a heat insulator is provided between the primary combustion space and the fuel supplying means.

* * * * *

UNITED STATES PATENT AND TRADEMARK OFFICE

CERTIFICATE OF CORRECTION

PATENT NO. : 4,279,589

DATED : July 21, 1981

INVENTOR(S) : YOSHIMI OHMUKAI ET AL

It is certified that error appears in the above—identified patent and that said Letters Patent is hereby corrected as shown below:

Column 6, line 55, "claim 6" should read -- claim 5 --.

Signed and Sealed this

*Second* Day of *February 1982*

[SEAL]

*Attest:*

GERALD J. MOSSINGHOFF

*Attesting Officer*

*Commissioner of Patents and Trademarks*